US011064289B2

(12) United States Patent
De Haan

(10) Patent No.: US 11,064,289 B2
(45) Date of Patent: Jul. 13, 2021

(54) LOUDSPEAKER WITH A WAVE FRONT SHAPING DEVICE

(71) Applicant: Alcons Audio B.V., Zwaag (NL)

(72) Inventor: Philip Derek Eduard De Haan, Zwaag (NL)

(73) Assignee: ALCONS AUDIO B.V., Zwaag (NL)

( * ) Notice: Subject to any disclaimer, the term of this patent is extended or adjusted under 35 U.S.C. 154(b) by 0 days.

(21) Appl. No.: 16/640,854

(22) PCT Filed: Sep. 3, 2018

(86) PCT No.: PCT/EP2018/073573

§ 371 (c)(1),
(2) Date: Feb. 21, 2020

(87) PCT Pub. No.: WO2019/043210

PCT Pub. Date: Mar. 7, 2019

(65) Prior Publication Data

US 2021/0044894 A1 Feb. 11, 2021

(30) Foreign Application Priority Data

Sep. 4, 2017 (NL) ..... 2019480

(51) Int. Cl.
*H04R 1/34* (2006.01)
*H04R 1/28* (2006.01)

(52) U.S. Cl.
CPC ..... *H04R 1/345* (2013.01); *H04R 1/2892* (2013.01)

(58) Field of Classification Search
CPC ..... H04R 1/345; H04R 7/04; H04R 7/045
See application file for complete search history.

(56) References Cited

U.S. PATENT DOCUMENTS 3,668,335 A 6/1972 Beveridge
5,163,167 A * 11/1992 Heil ..... G10K 11/26 181/152

(Continued)

FOREIGN PATENT DOCUMENTS

EP 1071308 A2 1/2001

OTHER PUBLICATIONS

International Search Report and Written Opinion for the International Patent Application No. PCT/EP2018/073573, dated Oct. 5, 2018, 11 pages.

(Continued)

*Primary Examiner* — Ryan Robinson
(74) *Attorney, Agent, or Firm* — Kacvinsky Daisak Bluni PLLC

(57) ABSTRACT

A loudspeaker includes a sound channel extending between the vibrating region of a membrane and the outer side of the loudspeaker, the central axis of the sound channel extending perpendicular to the membrane. The sound channel includes a wave front shaping portion arranged to transform the substantially flat wave front of the sound emitted from the membrane into a wave front having a cross section in the shape of a circular segment. The wave front shaping portion is divided into multiple sub-channels by divider walls that extend from an entrance opening to an exit opening of the wave front shaping portion. Seen in cross section the side walls of each sub-channel converge towards each other from the entrance opening to the exit opening. The centre line of each of the divider walls, seen in cross section, converge towards each other adjacent the exit opening.

15 Claims, 12 Drawing Sheets

(56) References Cited

U.S. PATENT DOCUMENTS

| | | | | |
|---|---|---|---|---|
| 5,778,084 | A * | 7/1998 | Kling | H04R 1/30 181/159 |
| 6,581,719 | B2 * | 6/2003 | Adamson | G10K 11/22 181/152 |
| 6,628,796 | B2 * | 9/2003 | Adamson | H04R 1/26 181/152 |
| 6,744,899 | B1 * | 6/2004 | Grunberg | H04R 1/30 381/340 |
| 6,950,530 | B2 * | 9/2005 | Baird | H04R 1/345 381/340 |
| 7,835,537 | B2 * | 11/2010 | Cheney | H04R 1/345 381/337 |
| 8,479,873 | B2 * | 7/2013 | Dodd | H04R 1/30 181/177 |
| 8,718,310 | B2 * | 5/2014 | Adams | H04R 1/323 381/340 |
| 2007/0080019 | A1 | 4/2007 | Kubota | |
| 2014/0262600 | A1 | 9/2014 | Hughes | |

OTHER PUBLICATIONS

International Perliminary Report for the International Patent Application No. PCT/EP2018/073573, dated Mar. 10, 2020, 8 pages.

* cited by examiner

"PRIOR ART"

"PRIOR ART"

"PRIOR ART"

"PRIOR ART"

LOUDSPEAKER WITH A WAVE FRONT SHAPING DEVICE

This is a national stage application filed under 35 U.S.C. § 371 of pending international application PCT/EP2018/073573, filed Sep. 3, 2018, which claims priority to Netherlands Patent application NL 2019480, filed Sep. 4, 2017, the entirety of which applications are hereby incorporated by reference herein.

The invention relates to a loudspeaker comprising a housing provided with a membrane which is mounted in a frame, which membrane is arranged to vibrate so as to produce sound having a substantially flat wave front, wherein said loudspeaker comprises a sound channel extending between a vibrating region of the membrane and the outer side of the loudspeaker, the central axis of said sound channel extending perpendicular to the membrane, wherein said sound channel comprises a wave front shaping portion arranged to transform the substantially flat wave front of the produced sound emitted from the membrane into a wave front having a cross section, seen in at least one direction, in the shape of a circular segment, wherein said wave front shaping portion of said sound channel is divided into multiple sub-channels by divider walls, wherein said divider walls extend from an entrance opening of said wave front shaping portion to an exit opening of said wave front shaping portion, wherein, seen in cross section in said at least one direction, the side walls of each sub-channel converge towards each other from the entrance opening to the exit opening of said wave front shaping portion. Such a loudspeaker is disclosed in U.S. Pat. No. 3,668,335 (Beveridge).

The wave front emitting from such a loudspeaker has a circular segment cross section (for instance spherical or cylindrical). In the case of U.S. Pat. No. 3,668,335, as well as in the preferred embodiment of the current invention, the wave front forms a cylindrical segment. In many sound applications it is desirable to have a wave front emitting from a loudspeaker which has a circular segment cross section with a fixed beam width angle (for instance approximately 90°) for all audible frequencies. It is furthermore desirable that the sound pressure level (SPL) does not show disturbing peaks or drops at certain off-axis angles for certain frequencies. Also it is desirable that the sound pressure level (SPL) at off-axis angles is not higher than the sound pressure level (SPL) near the central axis of the loudspeaker, as this is not the expected behaviour of a loudspeaker. The invention aims at achieving one or more of the these goals.

According to a first aspect of the invention the centre line of each of said divider walls, seen in cross section in said at least one direction, converge towards each other adjacent the exit opening of said wave front shaping portion.

According to a second aspect of the invention the centre line of each of said divider walls, seen in cross section in said at least one direction, forms a straight non-curved line over at least substantially its entire length within said wave front shaping portion.

Preferably said wave front shaping portion is arranged to transform the substantially flat wave front of the produced sound emitted from the membrane into a wave front having a cross section in the shape of a cylindrical segment, wherein said divider walls are flat plates.

Preferably, seen in a cross section perpendicular to said at least one direction, the side walls of each sub-channel diverge from each other, such that the wave front surface area remains substantially the same along the axial length of each sub-channel in order to avoid compression of the sound waves.

Preferably, seen in cross section in said at least one direction, the outer converging walls of the sound channel join diverging walls of a sound horn at the exit opening of said wave front shaping portion. Said divider walls are preferably not comprised with extensions extending into the space between the diverging walls of the sound horn. Preferably said wave front shaping portion is integral with the sound horn. Preferably said wave front shaping portion is connected to the loudspeaker housing by disconnectable attachment means.

In the preferred embodiment said loudspeaker is of the type as disclosed in international patent application publication no. WO 2004/080119 A1 (De Haan), which is incorporated herein by reference. Said loudspeaker is provided with a magnet unit that generates a magnetic field and the flat membrane is provided with an electrical conductor arranged in a pattern on the membrane, which membrane is positioned in the magnetic field in such a manner that a force is exerted when current is fed through the conductor pattern on the membrane, which force is capable of setting the membrane in vibrating motion so as to produce the sound, said conductor pattern being provided on the membrane in the vibrating region of said membrane, wherein said conductor pattern is provided on the membrane in at least two spaced-apart vibrating regions, the loudspeaker preferably being provided with at least two sound inner channels extending between the two vibrating regions and the entrance opening of said wave front shaping portion, wherein the central axes of the two inner sound channels, which are located between the outer wall and the inner wall of each inner sound channel, incline towards each other over a particular distance from the membrane. The outer walls of the two inner sound channels that are preferably positioned furthest away from each other incline towards each other over a particular distance from the membrane. The inner walls of the two inner sound channels that are positioned closest to each other preferably incline towards each other over at least a particular distance from the membrane. The inner wall and the outer wall of each inner sound channel preferably extend substantially parallel to each other. Said particular distance is preferably at least 0.5 time, more preferably at least 1 time, the width of the inner sound channels. The distance between the inner walls of the inner sound channels on the outer side of the housing is preferably less than 0.5 time, more preferably less than 0.2 time, the distance between the inner walls on the side of the membrane.

The invention also relates to a wave front shaping device having a sound channel with a wave front shaping portion arranged to transform a substantially flat wave front of a loudspeaker into a wave front having a cross section, seen in at least one direction, in the shape of a circular segment, wherein said wave front shaping sound channel is divided into multiple sub-channels by divider walls, wherein said divider walls extend from an entrance opening of said wave front shaping portion to an exit opening of said wave front shaping portion, wherein, seen in cross section in said at least one direction, the side walls of each sub-channel converge towards each other from the entrance opening to the exit opening of said wave front shaping portion, wherein the centre line of each of said divider walls, seen in cross section in said at least one direction, converge towards each other adjacent the exit opening of said wave front shaping portion. In the preferred embodiment said centre line forms a straight non-curved line over at least substantially its entire length within said wave front shaping portion. Said wave front shaping portion is preferably arranged to transform the substantially flat wave front of the loudspeaker into a wave front having a cross section in the shape of a cylindrical segment, wherein said divider walls are flat plates. Preferably, seen in cross section in said at least one direction, the outer converging walls of the sound channel join diverging walls of a sound horn at the exit opening of said wave front shaping portion. Said divider walls are preferably not comprised with extensions extending into the space between the diverging walls of the sound horn.

The invention also relates to a wave front shaping device having a sound channel with a wave front shaping portion arranged to transform a substantially flat wave front of a loudspeaker into a wave front having a cross section, seen in at least one direction, in the shape of a circular segment, wherein said wave front shaping sound channel is divided into multiple sub-channels by divider walls, wherein said divider walls extend from an entrance opening of said wave front shaping portion to an exit opening of said wave front shaping portion, wherein, seen in cross section in said at least one direction, the side walls of each sub-channel converge towards each other from the entrance opening to the exit opening of said wave front shaping portion, wherein, seen in a cross section perpendicular to said at least one direction, the side walls of each sub-channel diverge from each other, such that the wave front surface area remains substantially the same along the axial length of each sub-channel in order to avoid compression of the sound waves.

The invention will now be explained in more detail by means of embodiments as shown in the figures, in which.

Figure 6A:
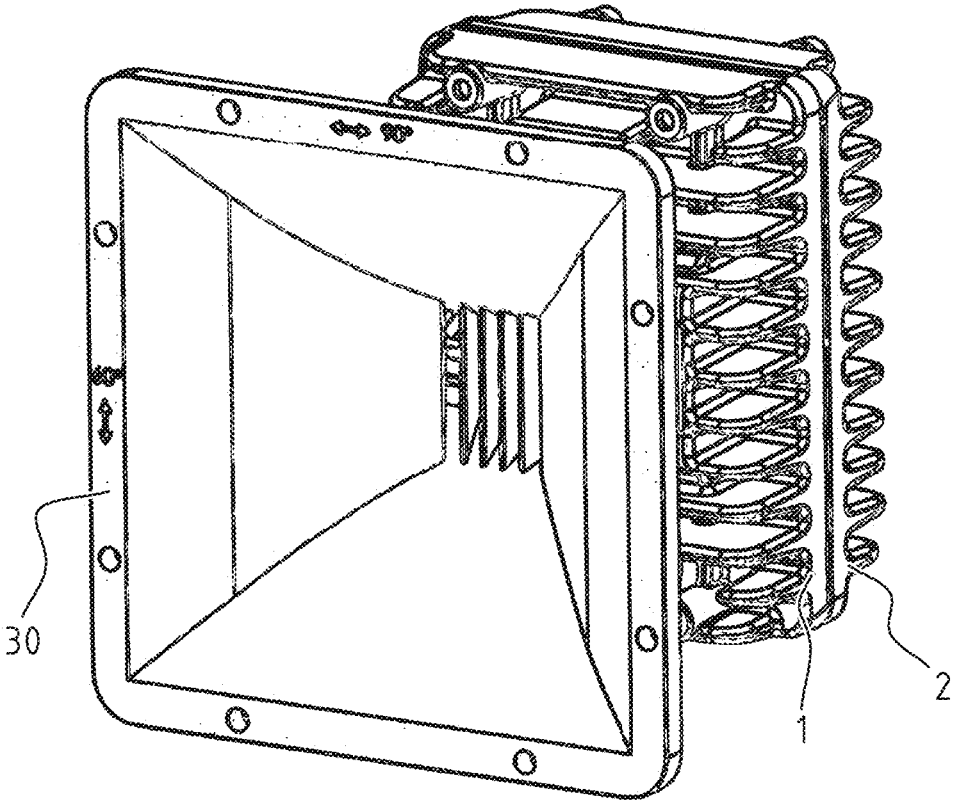
Figure 6B:
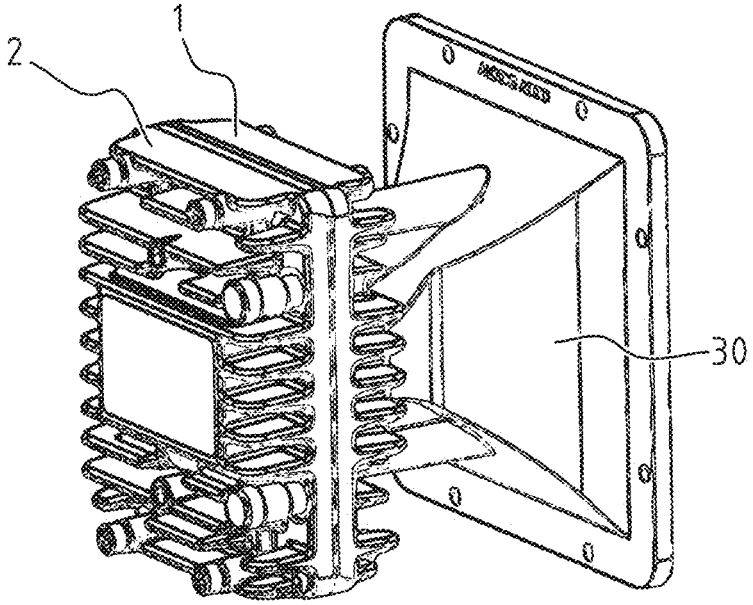
Figure 6C:
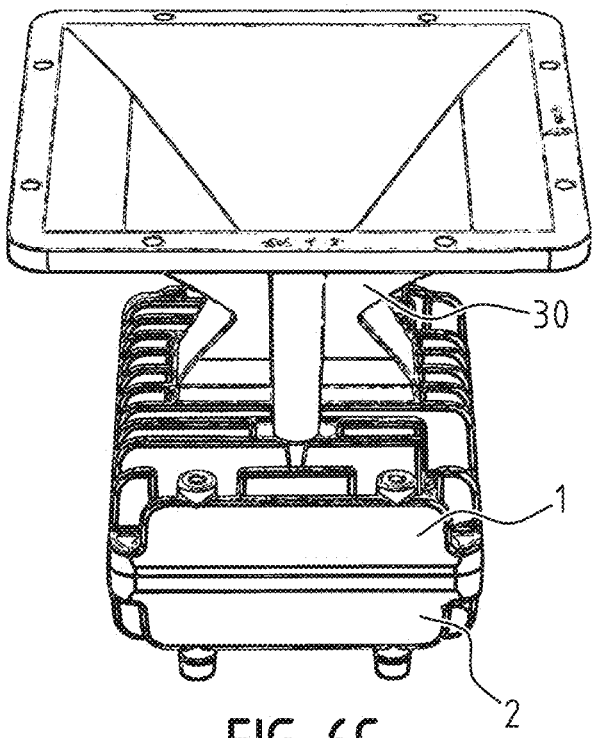
Figure 7A:
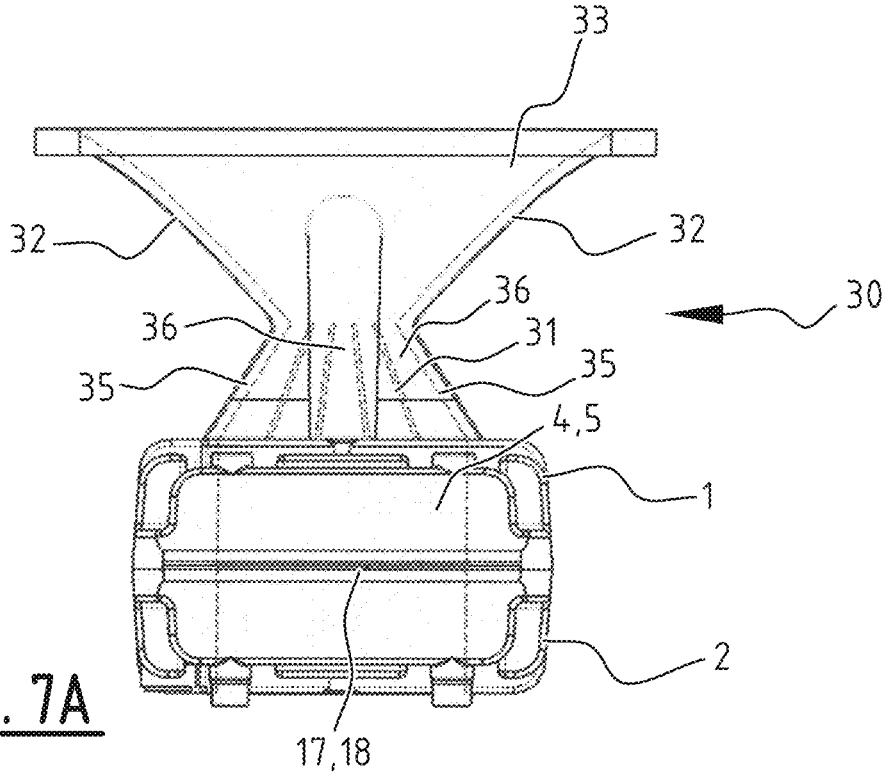
Figure 7B:
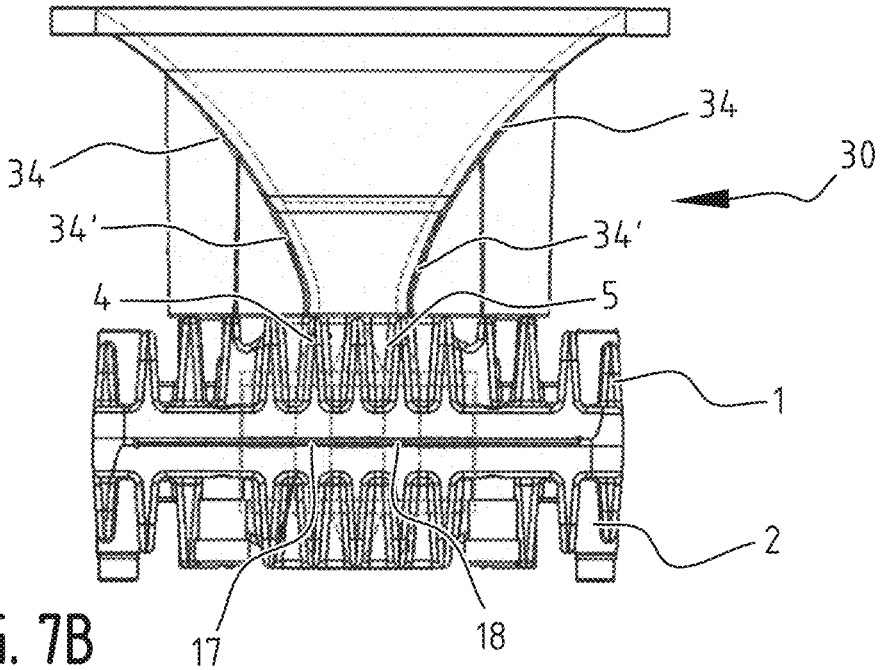
Figure 8:
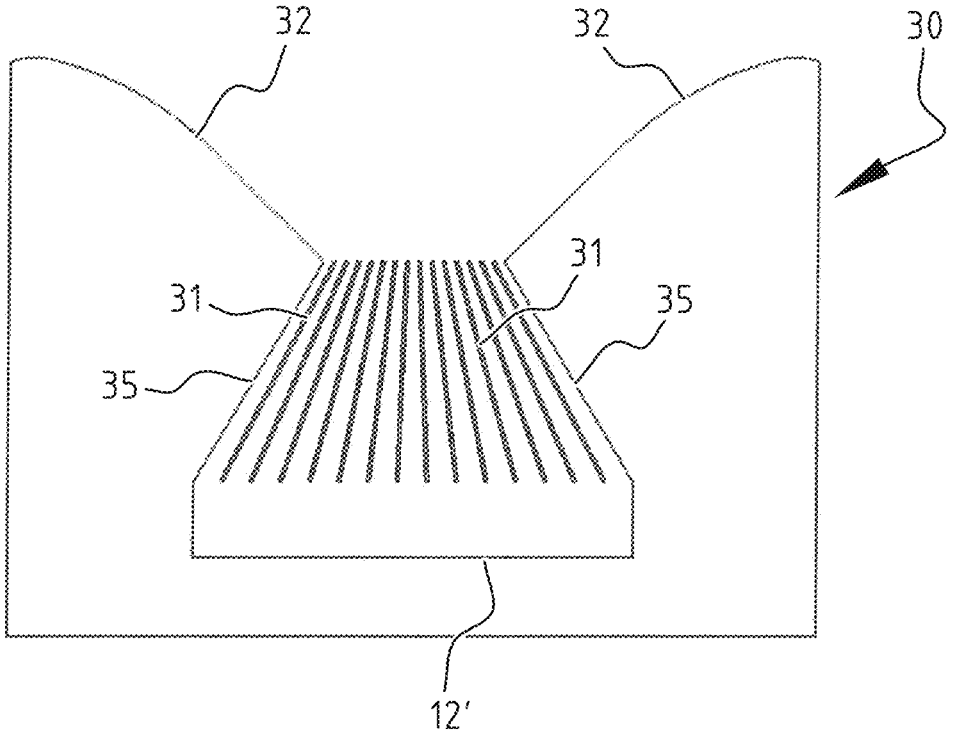
Figure 9A:
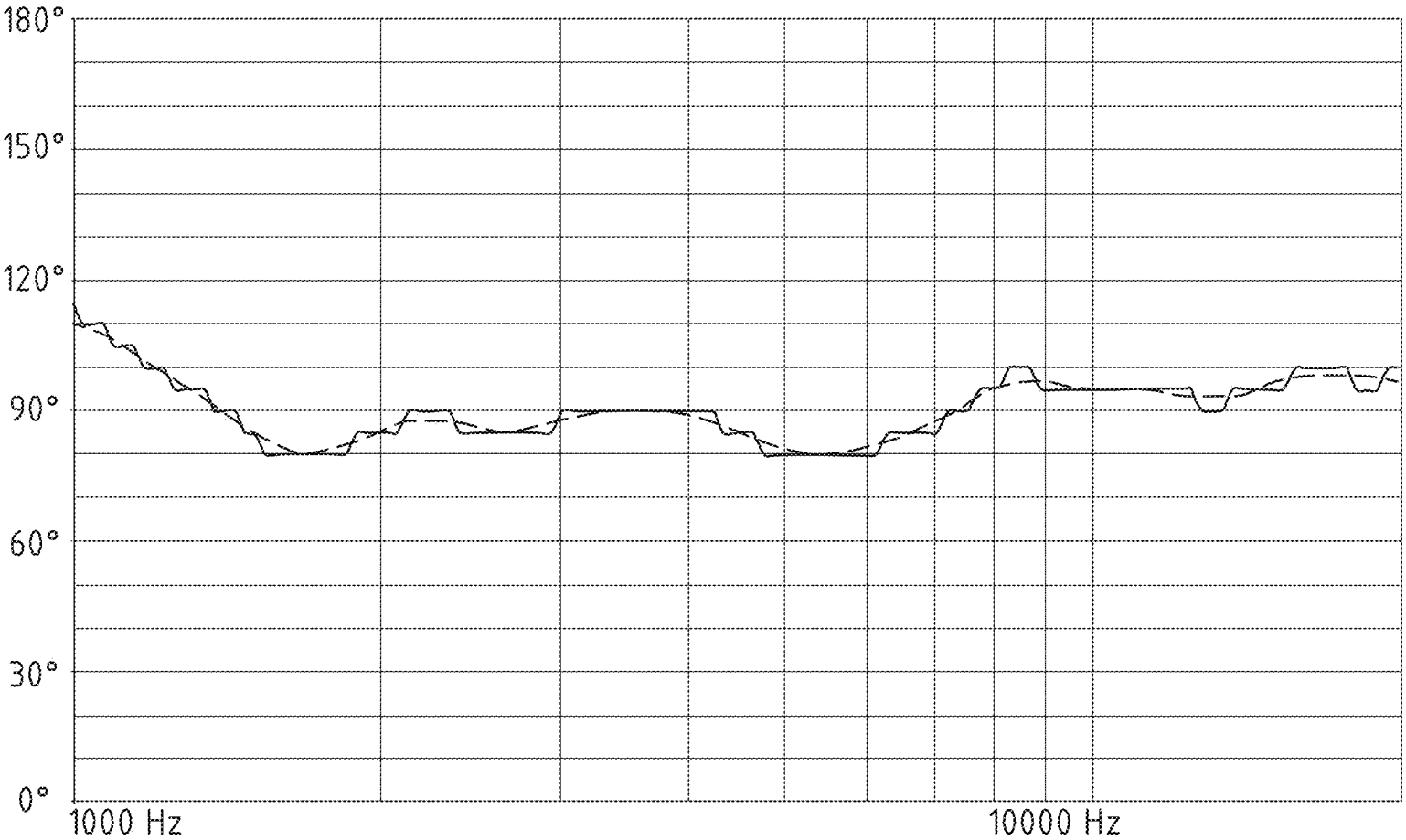
Figure 9B:
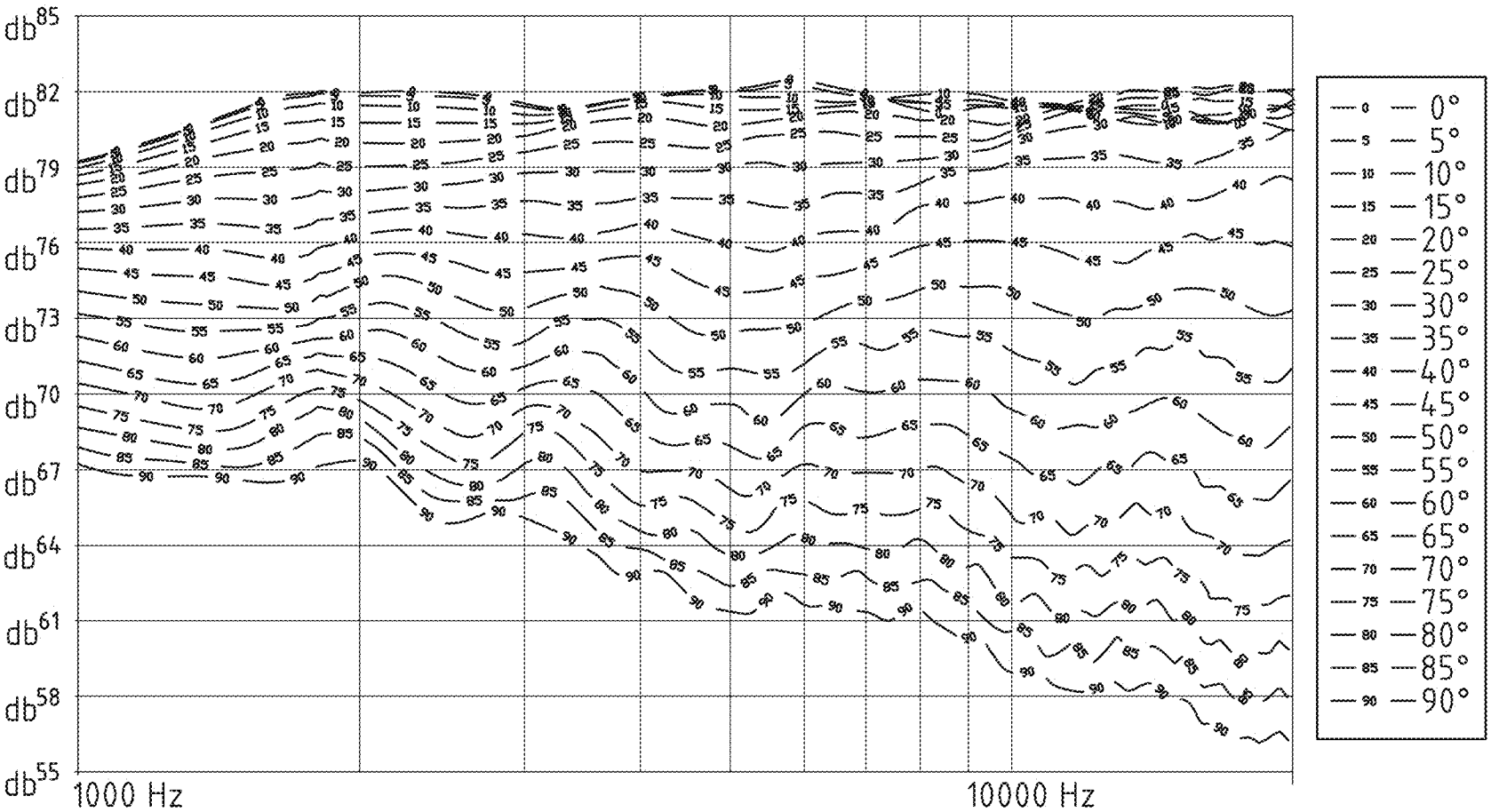
Figure 9C:
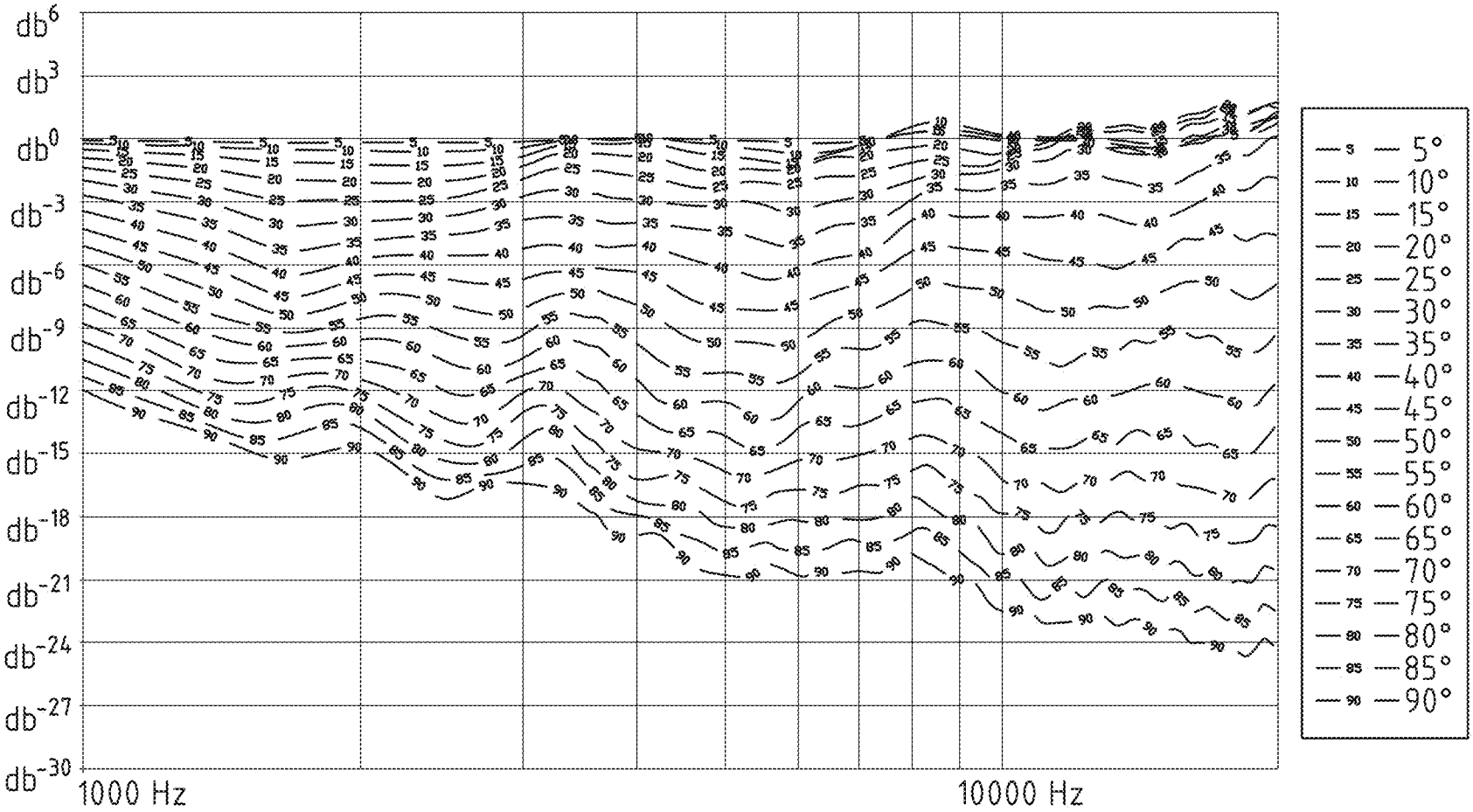

FIG. 6A-C are perspective views of a loudspeaker with a wave front shaping device in accordance with the invention;

FIG. 7A-B are schematic cross sectional views of the loudspeaker and the wave front shaping device of FIGS. 6 A-C;

FIG. 8 is a schematic cross sectional view of a wave front shaping device;

FIG. 9A is a graphic of a computer simulation of the cylindrical segment wave front beam width angle at various frequencies of the wave front shaping device of FIG. 8;

FIG. 9B is a graphic of a computer simulation of the sound pressure level (SPL) at various frequencies and off-axis angles of the wave front shaping device of FIG. 8; and FIG. 9C is a graphic of a computer simulation of the relative sound pressure level (SPL) at various frequencies and off-axis angles, relative to the on-axis sound pressure level (SPL), of the wave front shaping device of FIG. 8.

Figure 1:
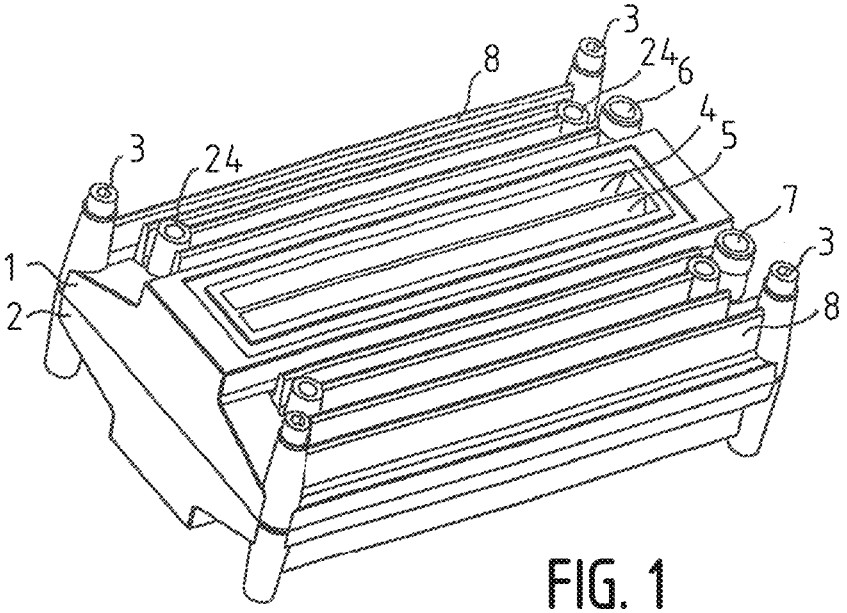
FIG. 1 is a perspective view of a prior art loudspeaker for use with the invention.

According to FIG. 1, the loudspeaker, as disclosed in international patent application publication no. WO 2004/080119 A1 (De Haan), comprises a housing which consists of two substantially identical metal parts 1, 2, which are mounted together by means of screws 3. Each housing part 1, 2 has two elongate slot-shaped recesses or sound channels 4, 5, which enable the sound that is generated in the loudspeaker to propagate towards the outside. Furthermore, a housing part 1 is provided with electrical connecting points 6, 7, to which the sound signal wires of an amplifier can be connected. The housing 1, 2 is provided with cooling fins 8 for dissipating the heat that is generated in the loudspeaker.

Figure 2:
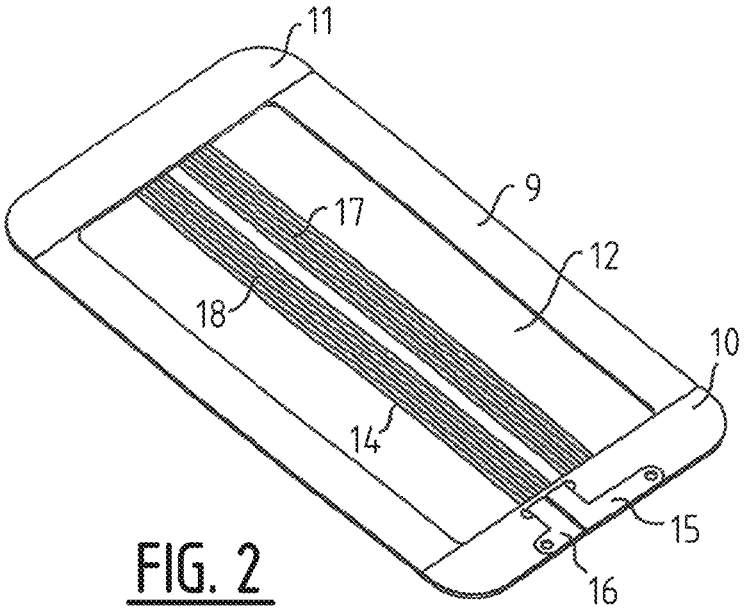
FIG. 2 is a perspective view of a flat membrane unit of the loudspeaker of FIG. 1.

The housing parts 1, 2 enclose a frame that is shown in FIG. 2, which consists of a first, frame-shaped frame member 9 and two strip-shaped frame members 10, 11. A vibrating membrane 12 is affixed to the frame member 9 and is provided with an electric conductor pattern 13, which is connected to the connecting points 6, 7 and which causes the membrane to vibrate when an electrical signal is supplied to the loudspeaker by the amplifier.

Figure 3:
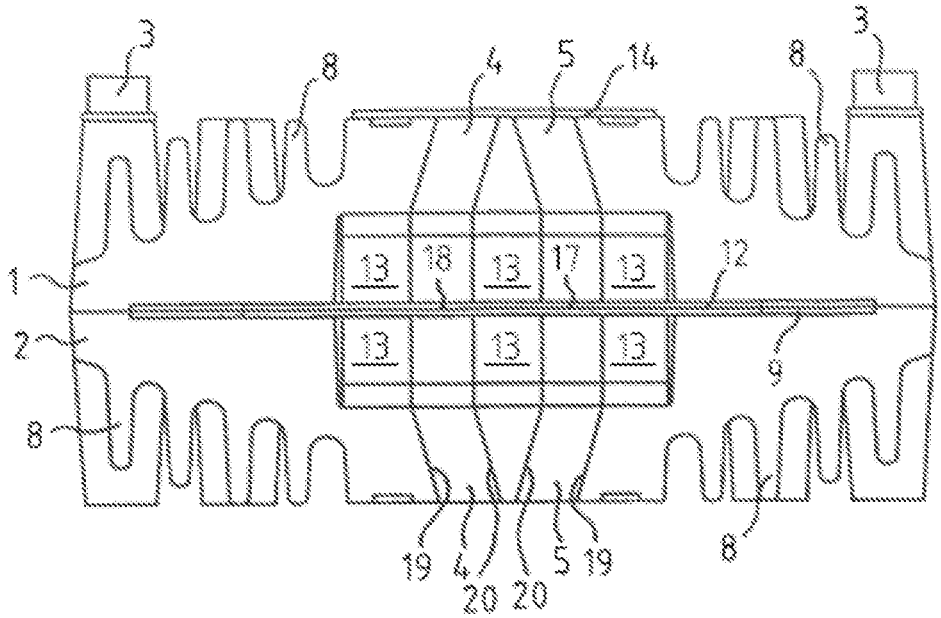
FIG. 3 is a cross-sectional view of the loudspeaker of FIG. 1.

To that end the loudspeaker comprises magnets 13 as shown in FIG. 3, which generate a permanent magnetic field within which the conductor pattern 14 of the membrane 12 is located. The conductor pattern 14 is formed by an electrically conducting wire arranged in an elongate, rectangular spiral on one side of the membrane 12.

The two ends of the conducting wire are connected to current feed-through connections 15, 16 on the frame member 10, which are in turn electrically connected to the connecting points 6, 7. The current feed-through connections 15, 16 are electrically insulated from the frame member 10. The lines of the conductor pattern 14 that extend parallel to each other in the longitudinal direction between the frame members 10, 11 form two spaced-apart vibrating regions 17, 18.

Referring to FIG. 3, the sound channels 4, 5 extend from a point located near the two spaced-apart vibrating regions 17, 18 on the surface of the membrane 12 to the outer side of the housing parts 1, 2; on one side the sound channels 4, 5 are closed by a closing plate, however, because the loudspeaker must emit the sound in only one direction. The sound channels 4, 5 initially extend in a direction perpendicularly to the membrane, seen from the membrane, viz. in the region between the magnets 13, and subsequently the sound channels 4, 5 incline towards each other. Both the outer walls 19 and the inner walls 20 of each sound channel 4, 5 incline towards each other, with the inner wall 19 and the outer wall 20 of a sound channels 4, 5 continuing to extend parallel to each other. On the outer side of the loudspeaker, only a small spacing remains between the inner walls 19 of the two sound channels 4, 5, which spacing is at least several times smaller than the spacing between the vibrating regions 17, 18. In this way the fronts of the sound waves that are generated by the two vibrating regions 17, 18 are directed towards each other and combined, so that disadvantageous interference between the two wave fronts is prevented. The combined wave front that is emitted from the sound channels 4, 5 thereby is a continuous flat rectangular wave front.

Figure 4:
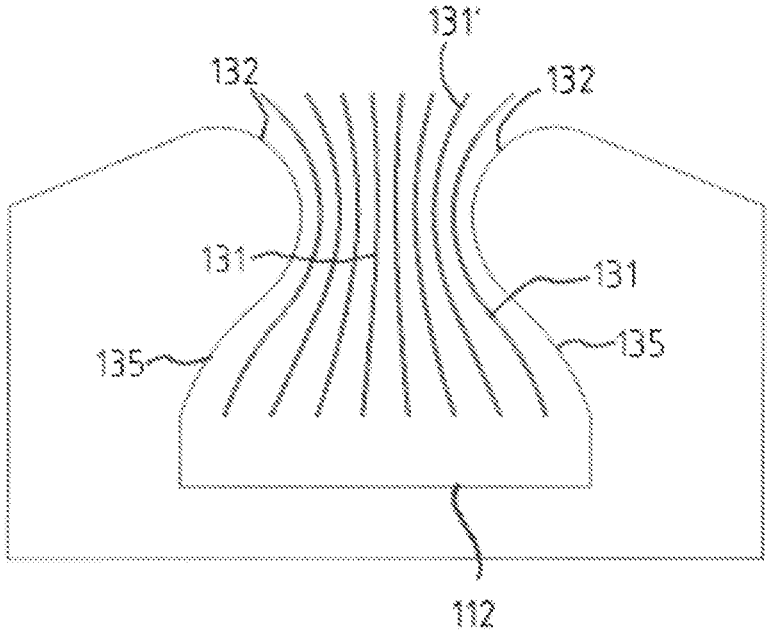
FIG. 4 is a schematic cross sectional view of a prior art wave front shaping device.

FIG. 4 is a schematic cross sectional view of a prior art wave front shaping device as disclosed in U.S. Pat. No. 3,668,335 (Beveridge). This prior art wave front shaping device comprises a wave front shaping portion 131, 135 having converging curved side walls 135 and a multitude of converging curved divider walls 131 there between, together forming a multitude of converging curved sound channels 136 in front of the flat vibrating diaphragm 112 of the electrostatic loudspeaker. Because the length of the sound channels 136 at the outer sides adjacent the side walls 135 are longer than the sound channels 136 adjacent the central axis of the loudspeaker, the wave front exiting from the wave front shaping portion 131, 135 is in the form of a cylindrical segment. The centre lines of each of the divider walls 131 are parallel to each other adjacent the exit opening of the wave front shaping portion (i.e. in the narrowest part of the sound channels). The wave front shaping device is further provided with a short sound horn with diverging side walls 132, and diverging extensions 131' of the divider walls 131 extend in the space between the side walls 132, thereby extending the sound channels 136 into the sound horn.

Figure 5A:
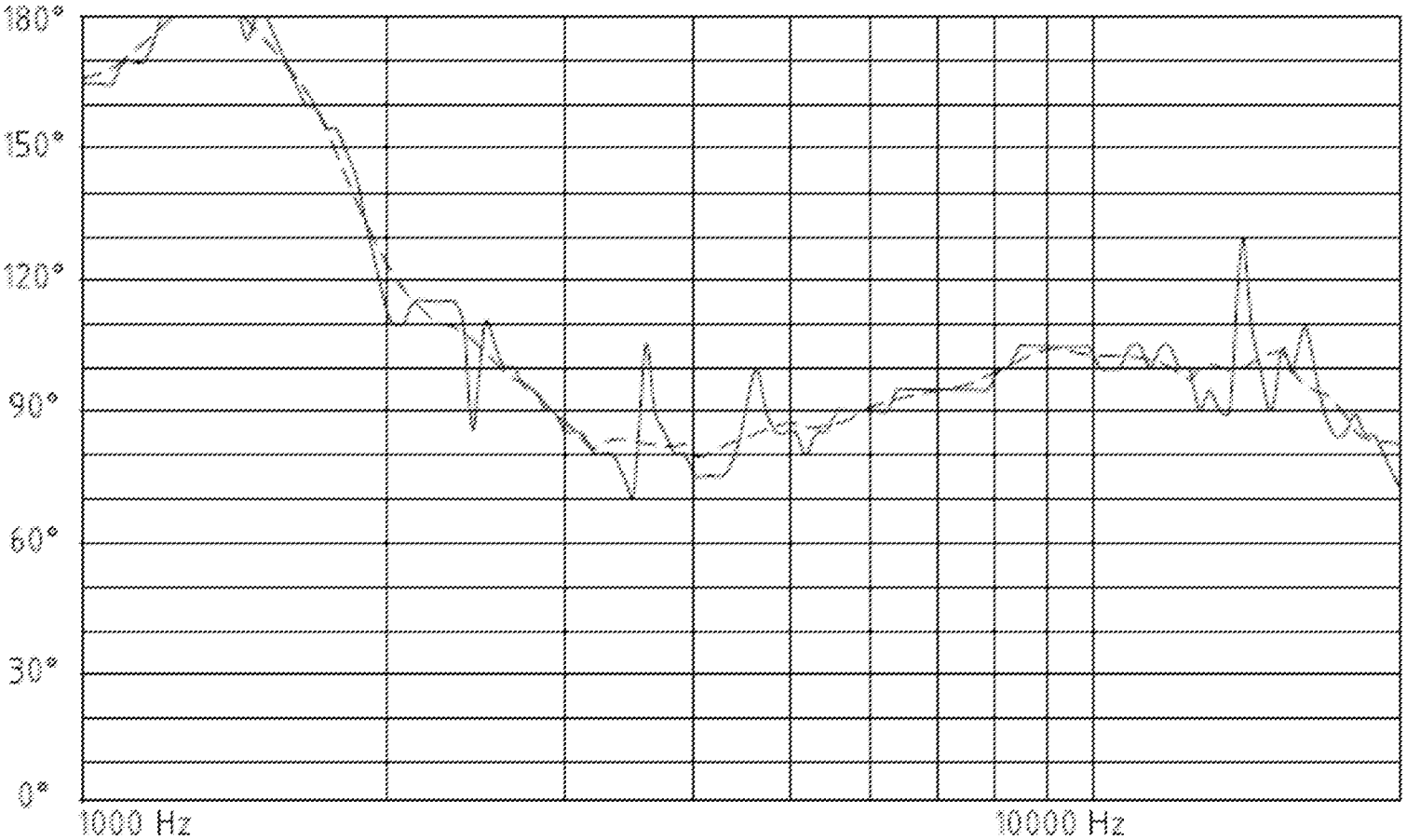
FIG. 5A is a graphic of a computer simulation of the cylindrical segment beam width angle at various frequencies of the prior art wave front shaping device of FIG. 4.

FIG. 5A is a graphic of a computer simulation of the cylindrical segment beam width angle (in °), defined by an SPL drop of 6 dB relative to the on-axis SPL, at various frequencies (logarithmic scale, in Hz) of the prior art wave front shaping device of FIG. 4. The graphic shows that, whereas the beam width angle at frequencies between 300 Hz and 20,000 Hz is approximately 90°, the beam width angle between 1000 Hz and 200 Hz is well over 120°, and also at approximately 13,000 Hz it is more than 120°.

Figure 5B:
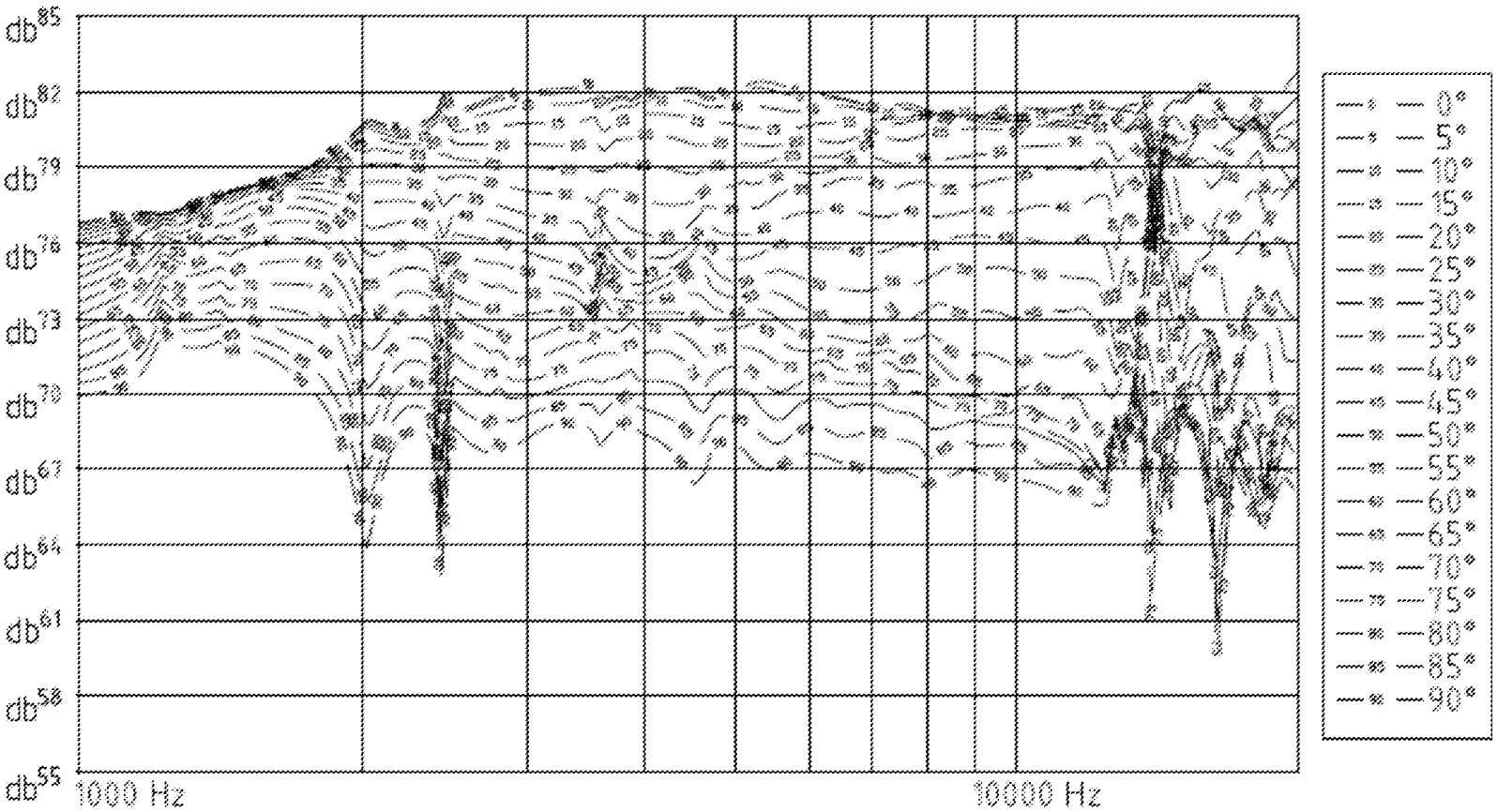
FIG. 5B is a graphic of a computer simulation of the sound pressure level (SPL) at various frequencies and off-axis angles of the prior art wave front shaping device of FIG. 4.

FIG. 5B is a graphic of a computer simulation of the sound pressure level (SPL, in dB) at various frequencies (logarithmic scale, in Hz) and off-axis angles (in °) of the prior art wave front shaping device of FIG. 4. The graphic shows that the SPL shows various sharp peaks and drops, notably at approximately 2,000 Hz, 1,300 Hz, and above 13,000 Hz, for various off-axis angles.

Figure 5C:
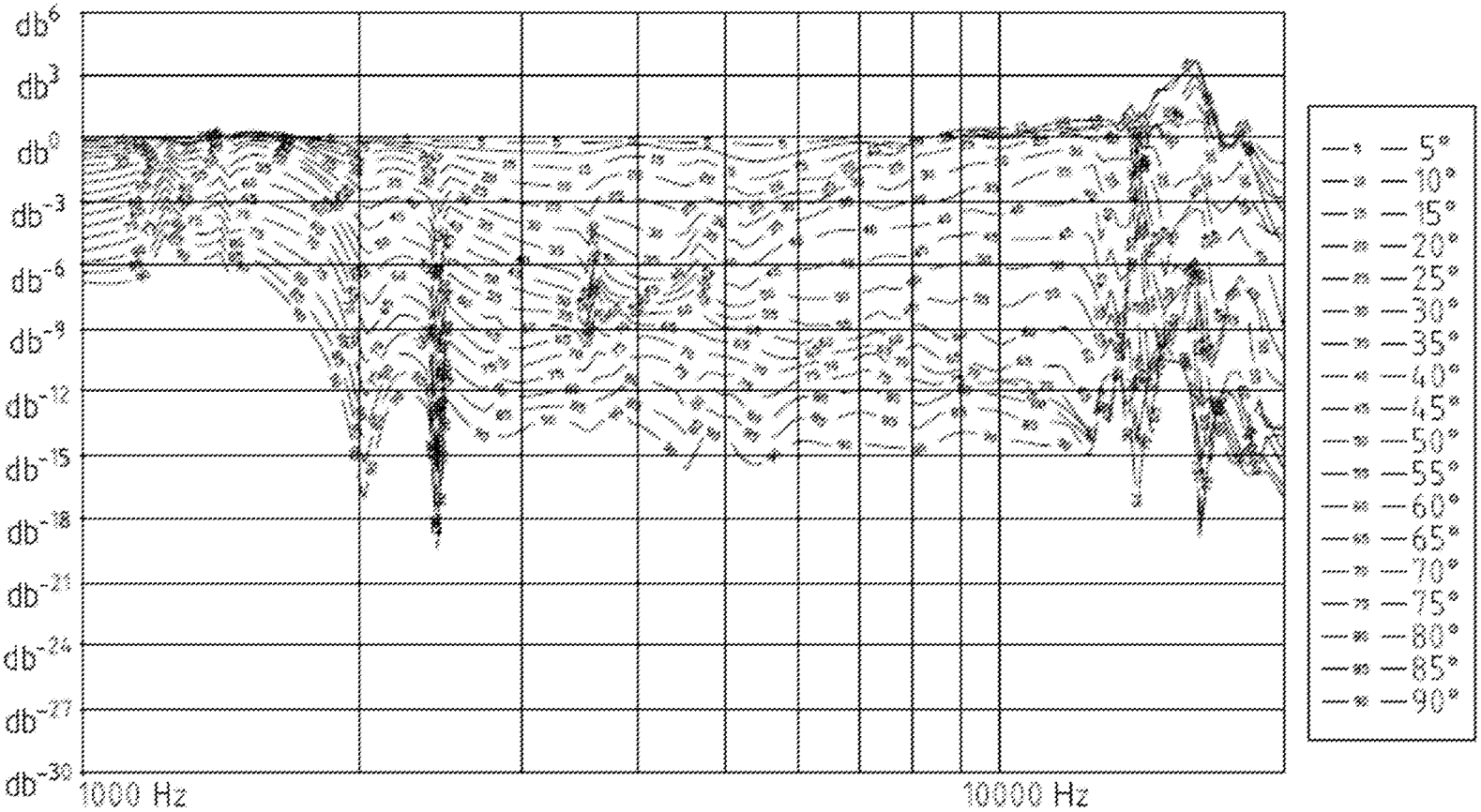
FIG. 5C is a graphic of a computer simulation of the relative sound pressure level (SPL) at various frequencies and off-axis angles, relative to the on-axis sound pressure level (SPL), of the prior art wave front shaping device of FIG. 4.

FIG. 5C is a graphic of a computer simulation of the relative sound pressure level (SPL, in dB) at various frequencies (logarithmic scale, in Hz) and off-axis angles (in °), relative to the on-axis sound pressure level (SPL), of the prior art wave front shaping device of FIG. 4. The graphic shows that for certain off-axis angles (5°-30°), at around 14,000 Hz the off-axis SPL is higher than the on-axis SPL. This is undesirable behaviour.

FIGS. 6 A-C show a wave front shaping device 30 which may be disconnectably mounted to the housing 1 of a loudspeaker in accordance with FIGS. 1-3 by means of screws. As shown in FIGS. 7A-B, the wave front shaping device according to the preferred embodiment of the invention comprises a wave front shaping portion 31, 35 having converging flat side walls 35 and a multitude of converging flat divider walls 31 extending in the space there between, together forming a multitude of converging sound channels 36, such that the side walls of the sound channels 36 converge towards each other adjacent the exit opening of the wave front shaping device. Because the length of the sound channels 36 at the outer sides adjacent the side walls 35 are longer than the sound channels 36 adjacent the central axis of the loudspeaker, the wave front exiting from the wave front shaping portion 31, 35 is in the form of a cylindrical segment. The number of converging divider walls 31 should be chosen such that the width of the sound channels 36 at their narrow exits should approximate the wave length of the highest audible frequency (approximately 20,000 Hz), i.e. approximately 17 mm.

The wave front shaping device is preferably provided with a sound horn 33 as shown in FIGS. 6A-C and FIGS. 7A-B. Seen in the cross section of FIG. 7A, the outer converging walls 35 of the wave front shaping portion join the diverging walls 32 of the sound horn 33. The sound horn 33 provides a gradual widening of the wave front that exits the wave front shaping portion before said front widens further in the environment.

Seen in the cross section of FIG. 7B, the sound horn 33 has continuously diverging walls 34', 34 between the outer ends of the sound channels 4, 5 of the loudspeaker and the outer end of the sound horn, as disclosed in international patent application publication no. WO 2004/080119 A1 (De Haan), of which the wall parts 34' form side walls of the wave front shaping portion. The side walls 34' of each sound channel 36 thereby diverge from each other, such that the wave front surface area remains substantially the same along the axial length of each sound channel 36 in order to avoid compression of the sound waves.

Also in this case, the wave front shaping device with the horn, which is made of a metal, contributes to the heat dissipation of the loudspeaker.

FIG. 8 is a schematic cross sectional view of a wave front shaping device in accordance with the invention.

FIG. 9A is a graphic of a computer simulation of the cylindrical segment wave front beam width angle (in °), defined by an SPL drop of 6 dB relative to the on-axis SPL, at various frequencies (logarithmic scale, in Hz) of the wave front shaping device of FIG. 8. The graphic shows that, the beam width angle at all frequencies is approximately 90°.

FIG. 9B is a graphic of a computer simulation of the sound pressure level (SPL, in dB) at various frequencies (logarithmic scale, in Hz) and off-axis angles (in °) of the wave front shaping device of FIG. 8. The graphic shows that for none of the frequencies the SPL has sharp peaks or drops for off-axis angles. Furthermore the SPL is generally higher than shown in the graphic of FIG. 5B.

FIG. 9C is a graphic of a computer simulation of the relative sound pressure level (SPL, in dB) at various frequencies (logarithmic scale, in Hz) and off-axis angles (in °), relative to the on-axis sound pressure level (SPL), of the wave front shaping device of FIG. 8. The graphic shows that the off-axis SPL is never substantially higher than the on-axis SPL.

The invention has thus been described by means of preferred embodiments. It is to be understood, however, that this disclosure is merely illustrative. Various details of the structure and function were presented, but changes made therein, to the full extent extended by the general meaning of the terms in which the appended claims are expressed, are understood to be within the principle of the present invention. The description and drawings shall be used to interpret the claims. The claims should not be interpreted as meaning that the extent of the protection sought is to be understood as that defined by the strict, literal meaning of the wording used in the claims, the description and drawings being employed only for the purpose of resolving an ambiguity found in the claims. For the purpose of determining the extent of protection sought by the claims, due account shall be taken of any element which is equivalent to an element specified therein.

The invention claimed is:

1. A loudspeaker comprising a housing provided with a flat membrane which is mounted in a frame, which flat membrane is arranged to vibrate so as to produce sound having a flat wave front, wherein said loudspeaker comprises a sound channel extending between a vibrating region of the flat membrane and the outer side of the loudspeaker, a central axis of said sound channel extending perpendicular to the flat membrane, wherein said sound channel comprises a wave front shaping portion arranged to transform the flat wave front of the produced sound emitted from the flat membrane into a diverging wave front having a cross section, seen in at least one direction, in the shape of a circular segment, wherein said wave front shaping portion of said sound channel is divided into multiple sub-channels by divider walls, wherein said divider walls extend from an entrance opening of said wave front shaping portion to an exit opening of said wave front shaping portion, wherein, seen in cross section in said at least one direction, side walls of each sub-channel converge towards each other from the entrance opening to the exit opening of said wave front shaping portion, wherein the centre line of each of said divider walls, seen in cross section in said at least one direction, converge towards each other adjacent the exit opening of said wave front shaping portion.

2. The loudspeaker of claim 1, wherein the centre line of each of said divider walls, seen in cross section in said at least one direction, forms a straight non-curved line over at least its entire length within said wave front shaping portion.

3. The loudspeaker of claim 1, wherein said wave front shaping portion is arranged to transform the flat wave front of the produced sound emitted from the flat membrane into a wave front having a cross section in the shape of a cylindrical segment.

4. The loudspeaker of claim 1, wherein said divider walls are flat plates.

5. The loudspeaker of claim 1, wherein, seen in a cross section perpendicular to said at least one direction, the side walls of each sub-channel diverge from each other, such that the wave front surface area remains the same along the axial length of each sub-channel in order to avoid compression of the sound waves.

6. The loudspeaker of claim 1, wherein seen in cross section in said at least one direction, the outer converging walls of the sound channel join diverging walls of a sound horn at the exit opening of said wave front shaping portion.

7. The loudspeaker of claim 6, wherein said divider walls are not comprised with extensions extending into the space between the diverging walls of the sound horn.

8. The loudspeaker of claim 6, wherein said wave front shaping portion is integral with the sound horn.

9. The loudspeaker of claim 1, wherein said wave front shaping portion is connected to the loudspeaker housing by disconnectable attachment means.

10. The loudspeaker of claim 1, wherein said loudspeaker is provided with a magnet unit that generates a magnetic field and the flat membrane is membrane provided with an electrical conductor arranged in a pattern on the flat membrane, which flat membrane is positioned in the magnetic field in such a manner that a force is exerted when current is fed through the conductor pattern on the flat membrane, which force is capable of setting the flat membrane in vibrating motion so as to produce the sound, said conductor pattern being provided on the flat membrane in the vibrating region of said flat membrane, wherein said conductor pattern is provided on the flat membrane in at least two spaced-apart vibrating regions, the loudspeaker being provided with at least two sound inner channels extending between the two vibrating regions and the entrance opening of said wave front shaping portion, wherein the central axes of the two inner sound channels, which are located between the outer wall and the inner wall of each inner sound channel, incline towards each other over a particular distance from the flat membrane.

11. A wave front shaping device having a sound channel with a wave front shaping portion arranged to transform a flat wave front of a loudspeaker into a diverging wave front having a cross section, seen in at least one direction, in the shape of a circular segment, wherein said wave front shaping sound channel is divided into multiple sub-channels by divider walls, wherein said divider walls extend from an entrance opening of said wave front shaping portion to an exit opening of said wave front shaping portion, wherein, seen in cross section in said at least one direction, side walls of each sub-channel converge towards each other from the entrance opening to the exit opening of said wave front shaping portion, and wherein the centre line of each of said divider walls, seen in cross section in said at least one direction, converge towards each other adjacent the exit opening of said wave front shaping portion.

12. The loudspeaker of claim 11, wherein the centre line of each of said divider walls, seen in cross section in said at least one direction, forms a straight non-curved line over at least its entire length within said wave front shaping portion.

13. The wave front shaping device of claim 12, wherein said wave front shaping portion is arranged to transform the flat wave front of the loudspeaker into a wave front having a cross section in the shape of a cylindrical segment, wherein said divider walls are flat plates.

14. The wave front shaping device of claim 12, wherein, seen in cross section in said at least one direction, the outer converging walls of the sound channel join diverging walls of a sound horn at the exit opening of said wave front shaping portion.

15. A wave front shaping device having a sound channel with a wave front shaping portion arranged to transform a flat wave front of a loudspeaker into a diverging wave front having a cross section, seen in at least one direction, in the shape of a circular segment, wherein said wave front shaping sound channel is divided into multiple sub-channels by divider walls, wherein said divider walls extend from an entrance opening of said wave front shaping portion to an exit opening of said wave front shaping portion, wherein, seen in cross section in said at least one direction, side walls of each sub-channel converge towards each other from the entrance opening to the exit opening of said wave front shaping portion, and wherein, seen in a cross section perpendicular to said at least one direction, the side walls of each sub-channel diverge from each other, such that the wave front surface area remains the same along the axial length of each sub-channel in order to avoid compression of the sound waves.

* * * * *